US006792920B2

(12) United States Patent
Niimi et al.

(10) Patent No.: US 6,792,920 B2
(45) Date of Patent: Sep. 21, 2004

(54) FUEL INJECTION APPARATUS FOR AN ENGINE

(75) Inventors: Atsushi Niimi, Saitama (JP); Hiroshi Uruno, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/305,240

(22) Filed: Nov. 27, 2002

(65) Prior Publication Data

US 2003/0136383 A1 Jul. 24, 2003

(30) Foreign Application Priority Data

Nov. 28, 2001 (JP) ..... 2001-362891
Sep. 26, 2002 (JP) ..... 2002-281994

(51) Int. Cl.[7] ..... F02M 41/00
(52) U.S. Cl. ..... 123/457; 123/458
(58) Field of Search ..... 123/457, 458, 123/459, 460–466, 511, 512, 513, 514

(56) References Cited

U.S. PATENT DOCUMENTS 4,173,434 A * 11/1979 Skinner ..... 417/294
5,280,774 A * 1/1994 Entenmann et al. ..... 123/457
5,372,159 A * 12/1994 Ziegelmeyer et al. .. 137/505.14
5,598,823 A * 2/1997 Povinger ..... 123/463

FOREIGN PATENT DOCUMENTS

JP 6-83951 U 12/1994

* cited by examiner

*Primary Examiner*—Mahmoud Gimie
(74) *Attorney, Agent, or Firm*—Birch, Stewart, Kolasch & Birch, LLP

(57) ABSTRACT

A redundant mechanism includes two pressure regulating valves for covering one of the pressure regulating valves when the other one is in a defective condition. First and second pressure regulating valves are provided as pressure regulating members of the fuel injection circuit. The valves are connected to the reflux passage and the by-pass passage that communicates with the fuel injection passage via the first and the second orifices, respectively. First and second sensors are provided for detecting the fuel pressure applied on the respective pressure regulating valves separately. A controller of the failure diagnostic member compares the fuel pressures P1, P2 detected by the first and second sensors and the predetermined fuel pressure P in the fuel injection passage. If P1=P2, both of the first and the second pressure regulating valves are determined to be normal. When a defective operating condition occurs in one of the pressure regulating valves, P1 and P2 vary. Therefore, it is determined to be abnormal based on the differential pressure and a display is activated.

11 Claims, 6 Drawing Sheets

FUEL INJECTION APPARATUS FOR AN ENGINE

BACKGROUND OF THE INVENTION

CROSS-REFERENCE TO RELATED APPLICATIONS

The present nonprovisional application claims priority under 35 USC 119 to Japanese Patent Application No. 2001-362891 filed on Nov. 28, 2001 and Japanese Patent Application No. 2002-281994 filed on Sep. 26, 2002 the entire contents thereof are hereby incorporated by reference.

1. Field of the Invention

The invention relates to a fuel injection apparatus for an engine, and more specifically, to a structure of pressure regulating means for regulating the fuel pressure constant and a pressure regulating valve constructing the same.

2. Description of Background Art

FIG. 6 shows an example of a pressure regulating circuit in a fuel injection apparatus in the related art, in which a reflux passage 3 is connected to an end of a fuel injection passage 2 to which a plurality of injectors 1 are connected. A pressure regulating means 4 is provided in this reflux passage 3 which opens the pressure regulating valve that constitutes the pressure regulating means 4 to return fuel from an exit 5 into a fuel tank 6 and controls the fuel pressure in the fuel injection passage 2 to a predetermined pressure when the fuel pressure in the fuel pressure injection passage 26 reaches or exceeds a predetermined value.

Fuel in this case is pumped from the fuel tank 6 to the other end of the fuel injection passage 2 by a fuel pump 7. The pressure regulating valve constituting the pressure regulating means 4 forms a closed space by putting a cap 9 on the housing 8 which is integral with the reflux passage 3. Thus, the interior of this closed space and the reflux passage 3 are in communication with each other through an entrance 8*a* provided on the housing 8. A valve body 10 is provided in the interior of the closed space for opening and closing a seat 11 which corresponds to an entrance of the pressure regulating valve, and is supported by a diaphragm 12 clamped between the housing 8 and the cap 9 around its outer periphery, so that the valve body 10 is pressed against the seat 11 by a spring 13 at a predetermined load.

The cap 9 is provided with a negative pressure pipe 14 for connecting an air chamber 15 on the cap 9 side defined by the diaphragm 12 and the intake passage of an engine, which is not shown in FIG. 6, so that the valve body 10 is opened by the depression at engine manifold by decreasing the pressure in the air chamber 15 to a negative pressure by a control means when the fuel pressure in the fuel injection passage 2 is increased to the pressure over a predetermined value. The internal space in the housing 8 defines a liquid chamber 16 blocked out from the air chamber 15 by a diaphragm 12, which is connected to the exit passage 5.

When the pressure regulating means 4 is constituted by a single pressure regulating valve, when such defective conditions wherein the valve body 10 is kept opened or closed are encountered, the fuel pressure in the fuel injection passage 2 may be decreased under or increased over the predetermined value. Therefore, a redundant pressure regulating means in the fuel injection apparatus for an engine provided with a plurality of pressure regulating valves is proposed in JP-U-6-83951. According to the redundant pressure regulating means, such an operational defect wherein one of the pressure regulating valves is kept opened by a breakdown or some other reasons, the other pressure regulating valve regulates the fuel pressure instead.

In the valve construction provided with a plurality of pressure regulating valves, when any one of the pressure regulating valve does not operate properly, another substitute pressure regulating valve carries out the fuel pressure regulation, and thus no problem is outwardly presented. Granted that it is adapted to notify an occurrence of defective conditions, it is difficult to recognize which valve is defective. Therefore, it has been desired to enable the operator to grasp the state of the defective conditions accurately.

Furthermore, since such defective conditions occur due to breakage of a diaphragm or damage of a spring in many cases, when the type which opens or closes the valve by depression at the engine manifold as shown in FIG. 3 is employed, it is desired to prevent fuel which entered into the air chamber 15 due to breakage of the diaphragm or the like from escaping from the air chamber. Accordingly, it is an object of the present invention to provide a pressure regulating means which realizes such requirements.

SUMMARY AND OBJECTS OF THE INVENTION

In order to solve the problem described above, the first aspect of the present invention provides a fuel injection apparatus for an engine including a fuel pump for pumping fuel from a fuel tank to a fuel injection passage, an injector for injecting fuel from the aforementioned fuel injection passage, and pressure regulating means disposed between the fuel injection passage and the fuel tank for regulating the fuel pressure in the aforementioned fuel injection passage at a constant value. The pressure regulating means includes a first pressure regulating valve and a second pressure regulating valve wherein the first pressure regulating valve and the second pressure regulating valve are connected at the entrances thereof to the aforementioned fuel injection passage via a first and second orifice, respectively The aforementioned first pressure regulating valve and the second pressure regulating valve are connected at the exits thereof to the aforementioned fuel tank, respectively. A first pressure sensor is provided for detecting the fluid pressure applied on the downstream of said first orifice. A second pressure sensor is provided for detecting the fluid pressure applied on the downstream of said second orifice. Failure diagnostic means are provided for notifying of the occurrence of the defective conditions to a driver by a predetermined display or the like when the pressures detected by the aforementioned first pressure sensor and the second pressure sensor are different.

The present invention includes the pressure regulating means having a diaphragm type fuel pressure regulating valve, an air chamber defined by the diaphragm in the interior of the fuel pressure regulating valve, a outside communication passage for communicating between the outside and the air chamber, and an escape prevention valve for closing the outside communication passage when fuel is entered into the air chamber.

The present invention includes the escape prevention valve that is a float type that is actuated by a buoyancy of fuel.

According to the present invention, the first and the second pressure regulating valves are provided as pressure regulating means, and the first and the second sensors are provided for the first and second pressure regulating valves, respectively. When the first and the second pressure regulating valves are normally operated, the equivalent fluid pressures are applied to the respective pressure regulating valves positioned downstream of the respective orifices. Therefore, the fluid pressures detected by the first and the second sensors are almost the same. Thus, the failure diagnostic means determines that the apparatus is in the normal condition.

When malfunction occurs in either one of the pressure regulating valves, the respective pressure regulating valves are connected to the fuel injection passage via the first and the second orifices, respectively. As a consequent, there is a difference between the fluid pressures applied on the respective fuel pressure regulating valves positioned downstream of the respective orifices. Therefore, the failure diagnostic means determines that the apparatus is in the abnormal condition from the pressure difference between the fluid pressures detected by the first and the second sensors, and thus allows the other normal pressure regulating valve to continue regulating operation, and notifies the operator of the occurrence of the defective conditions and which one is defective. Therefore, the operator can recognize the occurrence of the defective conditions and the part where such defective conditions are encountered immediately, and thus can take an adequate countermeasure.

According to the present invention, even when fuel enters into the air chamber because of a breakage of a diaphragm, further outflow of fuel through the outside communication port can be prevented since the escape prevention valve closes the outside communication port of the air chamber.

According to the present invention, since the escape prevention valve is provided, the escape of fuel may be prevented. In addition, since the escape prevention valve is a float utilizing the buoyancy of the fuel, the escape prevention valve may be constructed in a simple structure.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
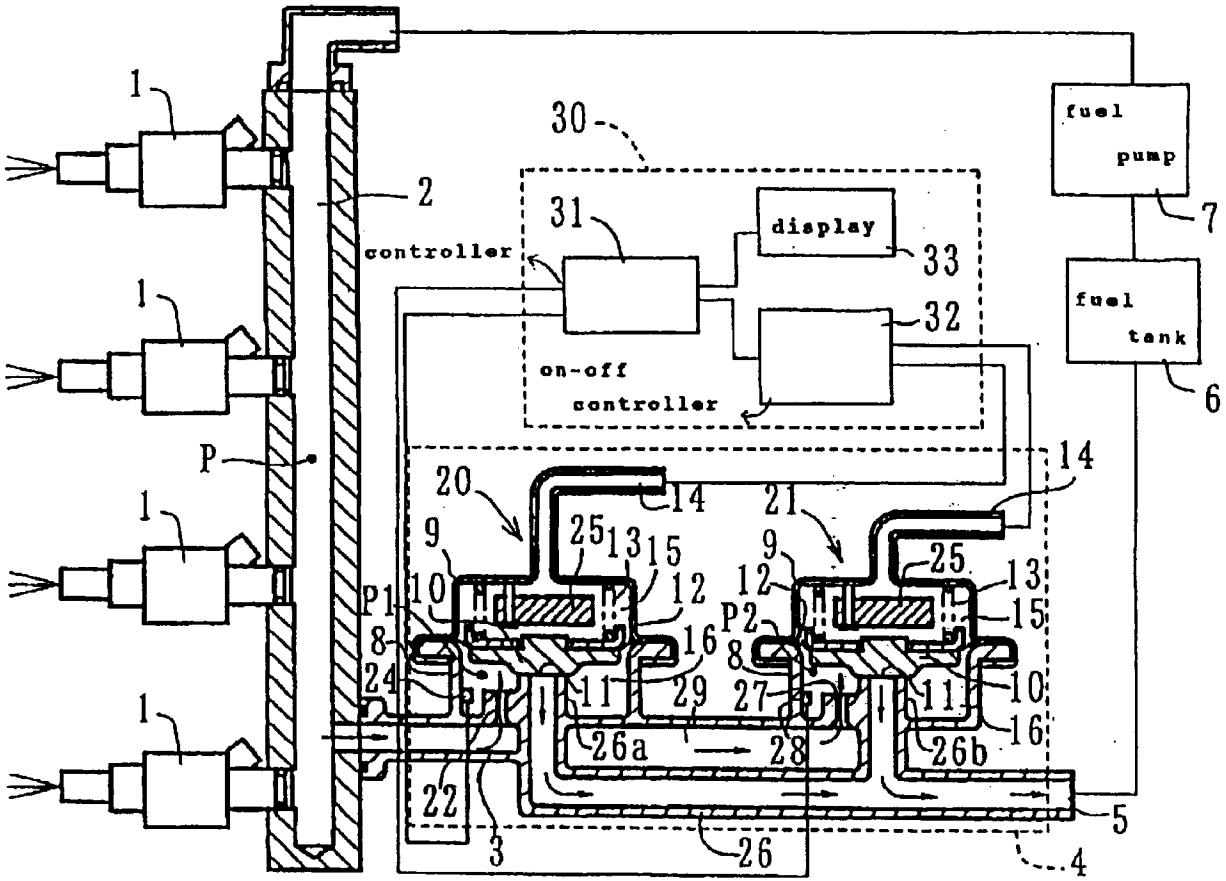
FIG. 1 is a drawing showing a fuel injection circuit according to the first embodiment.
Figure 2:
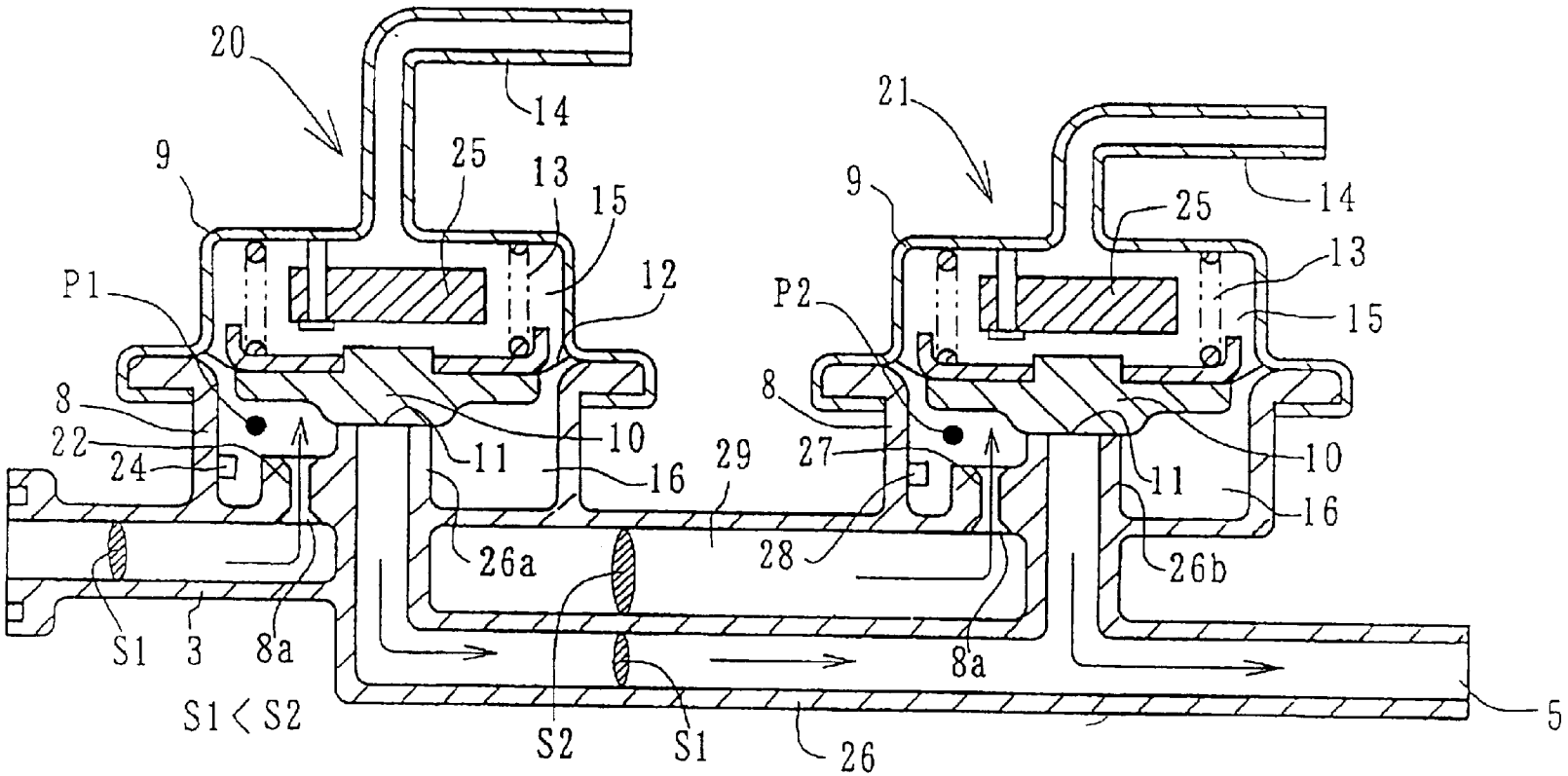
FIG. 2 is an enlarged cross-sectional view of the aforementioned pressure regulating means.

Referring now to the drawings, one embodiment is described. FIG. 1 is a drawing showing a fuel injection circuit according to the present embodiment. FIG. 2 is a cross-sectional view showing a pressure regulating means.

Figure 3:
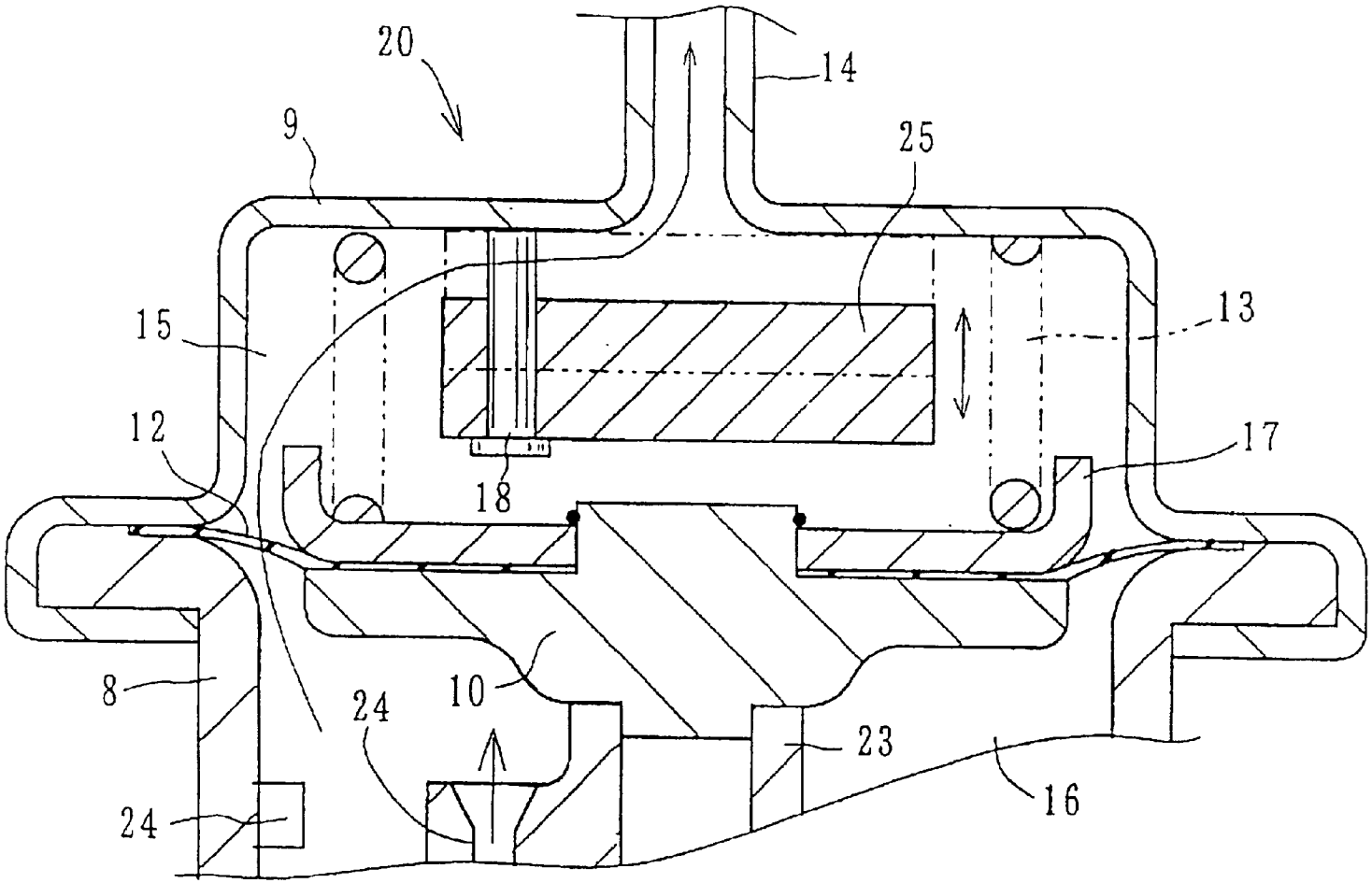
FIG. 3 is an enlarged cross-sectional view of the pressure regulating valve.

FIG. 1 illustrates an embodiment in conjuction with FIG. 3 wherein two pressure regulating valves are disposed as the pressure regulating means 4 as a redundant mechanism that includes two pressure regulating valves disposed in parallel with each other wherein a first pressure regulating valve 20 and a second pressure regulating valve 21 are described from upstream for convenience. The common parts in FIG. 3 are represented by common reference numerals and signs.

The first pressure regulating valve 20 and the second pressure regulating valve 21 are provided with a first sensor 24 and a second sensor 28, respectively, for detecting the fuel pressure applied on the respective pressure regulating valves. Information on the detected fuel pressures P1, P2 is supplied to a controller 31 constituting a failure diagnostic means 30, where the fuel pressure P in the fuel injection passage 2 and a predetermined injection valve opening pressure P0 (not shown) are compared as will be described later. When P1 is equal to P2, the controller 31 determines that both of the pressure regulating valves are in the normal condition. Thus, the controller 31 carries out a normal control that issues an instruction to an on-off controller 32 when required and provides a negative pressure to the interior of a air chamber 15 through the respective negative pressure pipes 14 of the respective pressure regulating valves to open the valve body 10 and allow fuel to escape from the exit passage 5 to the fuel tank 6.

The failure diagnostic means 30 carries out a normal pressure regulating control for the first and the second pressure regulating valves under a normal condition, and a control for the abnormal condition when either one of the pressure regulating valves is in the defective condition. The failure diagnostic means 30 is provided with the controller 31, the on-off controller 32, and a display 33.

The controller 31 includes an apparatus such as a microcomputer, compares the fuel pressures P1, P2 detected by the first sensor 24 and the second sensor 28, respectively, where P is a predetermined fuel pressure of the fuel injection passage 2, P0 is a injection valve opening pressure of the first pressure regulating valve 20 and of the second pressure regulating valve 21. The controller 31 carries out normal control for the first pressure regulating valve 20 and the second pressure regulating valve 21 and control for the abnormal condition when defective conditions are encountered as described above.

The injection valve opening pressure is set to P0=P1=P2. P0 is set to a value exceeding the allowable upper limit of the fuel pressure P.

The occurrence of an abnormal condition is determined by the controller 31 when there is a pressure difference between the fuel pressures P1, P2 applied on the first pressure regulating valve 20 and the second pressure regulating valve 21. This differential pressure exceeds a predetermined range. Under such an abnormal condition, the on-off controller 32 controls the pressure regulating valve which is normal and notifies it through the display 33.

The display 33 notifies of the occurrence of an abnormal condition and the place where an abnormal condition occurred through a sound such as a buzzer, or a light such as a lamp based on the instruction from the controller 31. The on-off controller 32 is constructed of an adequate member such as a solenoid valve, and controls the negative pressure source for turning the respective pressure regulating valves on and off intermittently.

As shown in FIG. 2 in detail, the first pressure regulating valve 20 is adapted to allow fuel entering from a reflux passage 3 through the first orifice 22 provided at the entrance 8*a* into the liquid chamber 16 to flow from the exit passage extension 26 to the exit passage 5, so that the flow of fuel directly from the liquid chamber 16 to the exit passage extension 26 is continued and interrupted by opening and closing a seat 11 at the extremity of the end portion 26*a* of the exit passage extension 26 in the housing 8 by means of a valve body 10.

The first orifice 22 is for controlling the amount of return flow of fuel, and a size which provides a lowest limit setting pressure with the full quantity of flow in the reflux passage 3 is selected. The first sensor 24 for detecting the fuel pressure applied on the first pressure regulating valve 20 is provided on the inner wall of the housing 8 facing toward the liquid chamber 16 in the vicinity of the first orifice 22. The fuel pressure in the liquid chamber 16 that is detected by the first sensor 24 is represented by P1. Though a float 25 is provided inside the cap 9, the detail description will be made later.

The exit passage extension 26 is shaped like a pipe including an end portion 26*a* to be connected to the first pressure regulating valve 20 and a body portion extending from the end portion 26*a* at a right angle toward the downstream. The downstream side of the body portion continues into the exit passage 5. The body portion of the exit passage extension 26 is formed integrally and in parallel with a by-pass passage 29, and includes a unitary branch pipe 26*b* projecting upwardly in FIG. 2 at the midsection thereof. The branch pipe 26*b* projects into the center of the interior of the liquid chamber 16 to communicate the liquid chamber 16 and the body portion of the exit passage extension 26, and is formed with the seat 11 at the end on the side of the liquid chamber, which is opened and closed by the valve body 10.

The second pressure regulating valve 21 is provided in the housing formed integrally at the end of the by-pass passage 29 extending continuously from the reflux passage 3 toward downstream. The second pressure regulating valve 21 has almost the same construction as the first pressure regulating valve 20. The housing 8 of the first pressure regulating valve 20 is integrally formed with the reflux passage 3 and the by-pass passage 29.

The by-pass passage 29 has a cross-sectional area S2 larger than the cross-sectional area S1 of the reflux passage 3, and communicates with the passage portion intersecting with the end portion 26*a* though it is not clearly shown in FIG. 1 and FIG. 2. The cross-sectional area of the reflux passage 3 and of the exit passage extension 26 are almost the same S1.

An entrance 8*a* is formed at the downstream end of the by-pass passage 29, and is in communication with the liquid chamber 16 of the second pressure regulating valve 21 via the second orifice 27 provided at the entrance 8*a*. The second orifice 27 is for controlling the amount of return flow with respect to the second pressure regulating valve 21 as in the case of the first orifice 22. A size of the second orifice 27 which provides a lowest limit setting pressure with the full quantity of flow in the reflux passage 3 is selected.

The second sensor 28 is provided in the liquid chamber 16 of the second pressure regulating valve 21 in the vicinity of the second orifice 27. The second sensor 28 detects the fuel pressure P2 in the liquid chamber 16 applied on the second pressure regulating valve 21 positioned downstream of the second orifice 27. The first orifice 22 and the second orifice 27 are adapted to maintain the fuel pressures P1, P2 at the same pressure (P1≈P2 ) when the first pressure regulating valve 20 and the second pressure regulating valve 21 are normally operated.

The liquid chambers 16, 16 formed in the respective housings 8, 8 of the first pressure regulating valve 20 and the second pressure regulating valve 21 are directly connected by the by-pass passage 29, so that fuel flows into the liquid chamber 16 of the second pressure regulating valve 21 even when the valve body 10 of the first pressure regulating valve 20 is closed. The exit passage 5 is provided at the downstream end of the exit passage extension 26 and forms a passage for combined fuel from the first pressure regulating valve 20 and the second pressure regulating valve 21.

FIG. 3 is an enlarged internal construction of the first pressure regulating valve 20 (the same for the second pressure regulating valve 21), in which the valve body 10 integrates and clamps the central portion of the diaphragm 12 with a spring retainer 17 with a spring 13 formed as a coil spring being disposed between the spring retainer 17 and the cap 9. The outer peripheral portion of the diaphragm 12 is clamped between the housing 8 and the flanges of the cap 9.

A float 25 made of a substance the relative density of which is less than a fuel such as foamed resin or the like is disposed in a space in a coil portion of a spring 13, and is moved vertically while being guided by the guide 18 extending downwardly from the top of the cap 9, so that the float 25 moves upwardly by a buoyancy to close the opening of the negative pressure pipe 14 when fuel enters within the cap 9. When the buoyancy is below a constant value, it moves downwardly and opens the opening of the negative pressure pipe 14. The lower end of the guide 18 serves as a stopper for downward movement. The float 25 is an example of the escape prevention valve. The opening facing toward the air chamber 15 of the negative pressure pipe 14 is an example of the outside communication port.

The operation of the present embodiment will now be described. In FIG. 1 and FIG. 2, when both of the first pressure regulating valve 20 and the second pressure regulating valve 21 are normal, the following expression:

$$P<P0=P1=P2$$

will be satisfied. Under this normal condition, the first pressure regulating valve 20 and the second pressure regulating valve 21 are closed, respectively, whereby the reflux passage 3 and the fuel tank 6 are not connected, and the fuel pressure in the fuel injection passage 2 is maintained in a predetermined value P.

When the fuel pressure of the fuel injection passage 2 increases, and the expression $P \geqq P0=P1=P2$ is satisfied, the valve bodies 10 of the first pressure regulating valve 20 and the second pressure regulating valve 21 are opened by the respective fuel pressures P1, P2, so that the fuel is refluxed from the reflux passage 3 and the exit passage extension 26 through the exit passage 5 into the fuel tank 6 to lower the fuel pressure in the fuel injection passage 2 to the normal value.

When the first pressure regulating valve 20 and the second pressure regulating valve 21 are abnormal, for example, when the defective condition that the first pressure regulating valve 20 is kept opened, fuel continuously flows from the first pressure regulating valve 20 through the end portion 26*a* to the exit passage extension 26. However, the first orifice 22 reduces the quantity of fuel flowing out to maintain the lower setting pressure, and the remaining fuel in the reflux passage 3 passes through the by-pass passage 29 into the housing 8 of the second pressure regulating valve 21.

On the other hand, since the second pressure regulating valve 21 is in the normal condition, it is on-off controlled based on the injection valve opening pressure P0. Thus, the fuel pressure in the fuel injection passage 2 can be maintained at P even when the first pressure regulating valve 20 is in an abnormal condition. In this case, since the fuel pressure applied on the respective pressure regulating valves differs due to the presence of the first orifice 22 and the second orifice 27, the fuel pressure P1 of the first pressure regulating valve 20 in an abnormal condition decreases. Thus, P1 is smaller than P2 (P1<<P2).

Therefore, after having detected the differential pressure, the fact that an abnormal condition is present and that the abnormal condition occurs at the first pressure regulating valve 20 on the low-pressure side is notified through the display 33.

The same control is made when the second pressure regulating valve 21 is kept opened. In this case, since the fuel pressure P2 of the second pressure regulating valve 21 in an abnormal condition decreases, P1 is larger than P2 (P1>>P2). After having detected the differential pressure, the fact that an abnormal condition is present and that the abnormal condition occurs at the second pressure regulating valve 21 on the low-pressure side is notified through the display 33.

On the other hand, if either one of the two pressure regulating valves is kept closed, the other normal pressure regulating valve receives the full quantity of flow. In this case, the entire fuel pressure may be controlled to a constant value by keeping the other normal pressure regulating valve opened almost constantly to reduce the entire fuel pressure. Even when the fuel pressure increases temporarily, since the size of the orifice is selected to secure the predetermined setting pressure with the full quantity of flow, the fuel pressure is gradually lowered due to fuel consumption of the engine, and thus it becomes controllable again.

In such an abnormal condition that the valve is kept closed, the fuel pressures P1 and P2 when the first and second pressure regulating valves 20, 21 are both closed are the same on the abnormal side and on the normal side. Thus, no differential pressure exists. Therefore, the controller 31 issues an instruction to start the control to the first and the second pressure regulating valves 20, 21 simultaneously. As a consequent, the valve on the normal side opens and the pressure detected by the sensor is lowered. In this case, the valve on the low-pressure side is controlled after the instruction is determined to be normal for display and the like.

In this manner, since the redundant mechanism is constructed by providing the first and the second pressure regulating valve 20, 21, even when one of the pressure regulating valves is in a defective condition, the fuel pressure of the fuel injection passage 2 can be maintained in the vicinity of a predetermined fuel pressure P to prevent malfunction of the engine. The occurrence of the defective conditions and the place where the defective condition occurs may be recognized immediately, whereby quick and adequate countermeasure for the defective conditions may be taken.

When two pressure regulating valves (20, 21) are provided as in this embodiment, the sizes of the orifices have to be set to the lowest value so that the fuel pressure P is maintained even when the pressure regulating valves are kept closed. Therefore, when the fuel consumption of the engine increases with the pressure regulating valve kept opened, there is a possibility that the entire fuel pressure in the fuel injection passage 2 is lowered.

Such possibility may be eliminated by additionally providing a third pressure regulating valve having the same construction as the first and the second pressure regulating valves 20 and 21. In other words, the third pressure regulating valve is connected as a parallel conduit line as in the case of the first and the second pressure regulating valves, and the sizes of the respective orifices are selected to provide the lowest limit setting pressures with half the full quantity of flow. Even when one of these pressure regulating valves is kept opened in this state, the orifice thereof serves as a resistance and thus keeps the lowest limit setting pressure with half the full quantity of flow. Thus, the remaining half of the full quantity of flow is applied to the remaining two pressure regulating valves. Therefore, the fuel pressure in the fuel injection passage 2 may be controlled by controlling the two normal pressure regulating valves.

In other words, since the orifice on the side of the abnormal pressure regulating valve serves as a resistance, and the quantity of flow applied to the two normal pressure regulating valves is as much as about half the full quantity, it is possible to increase the fuel pressure to a value over the predetermined pressure by closing these two normal pressure regulating valves, or to reduce the fuel pressure to the value below the predetermined pressure by opening one or both of these two normal pressure regulating valves.

When one of these three pressure regulating valves is kept closed, the full quantity of flow is applied to two normal pressure regulating valves. In this case, the remaining two pressure regulating valves can maintain the fuel pressure at a constant value by each controlling half the full quantity of flow. In this case, even when the fuel pressure increases temporarily, the fuel pressure is lowered by fuel consumption of the engine, and thus it becomes controllable again.

As shown in FIG. 3, when the fuel enters in the air chamber 15 on the cap 9 side with the valve body 10 opened for some reasons, since the relative density of the float 25 is smaller than the fuel, it moves upwardly while being guided by the guide 18, and then comes into close contact with the cap 9 to close the opening of the negative pressure pipe 14.

Therefore, even when the fuel enters into the air chamber 15, the float 25 that serves as an escape prevention valve closes the negative pressure pipe 14 that is an outside communication port of the air chamber 15, whereby the fuel is prevented from entering from the negative pipe 14 into an air intake passage of the engine, thereby preventing the fuel from escaping toward the outside. In addition, since the escape prevention valve is formed of a float utilizing a buoyancy of the fuel, the escape prevention valve may be constructed in a simple structure.

Figure 4:
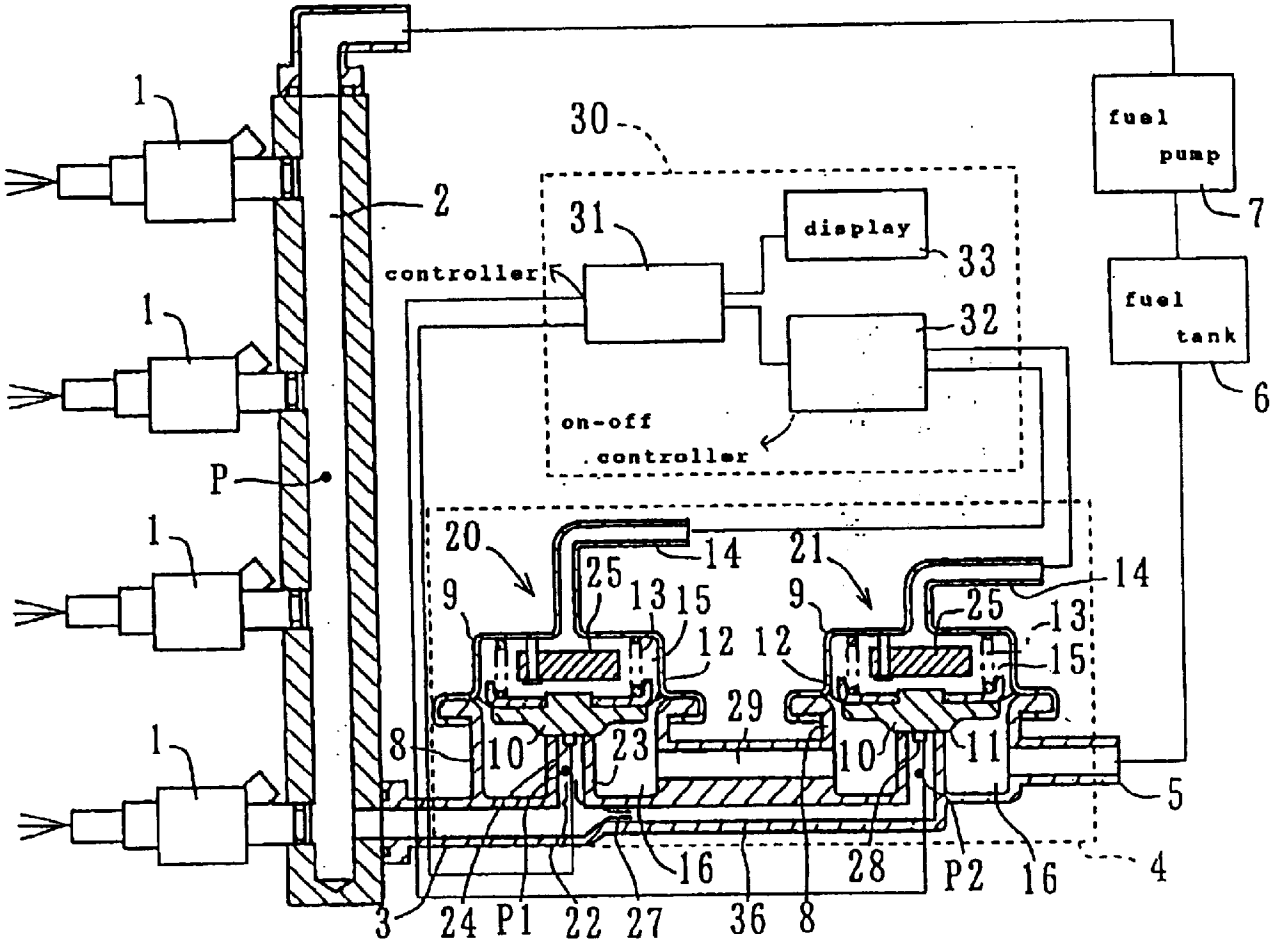
FIG. 4 is a drawing relating to the second embodiment, which corresponds to FIG. 1.
Figure 5:
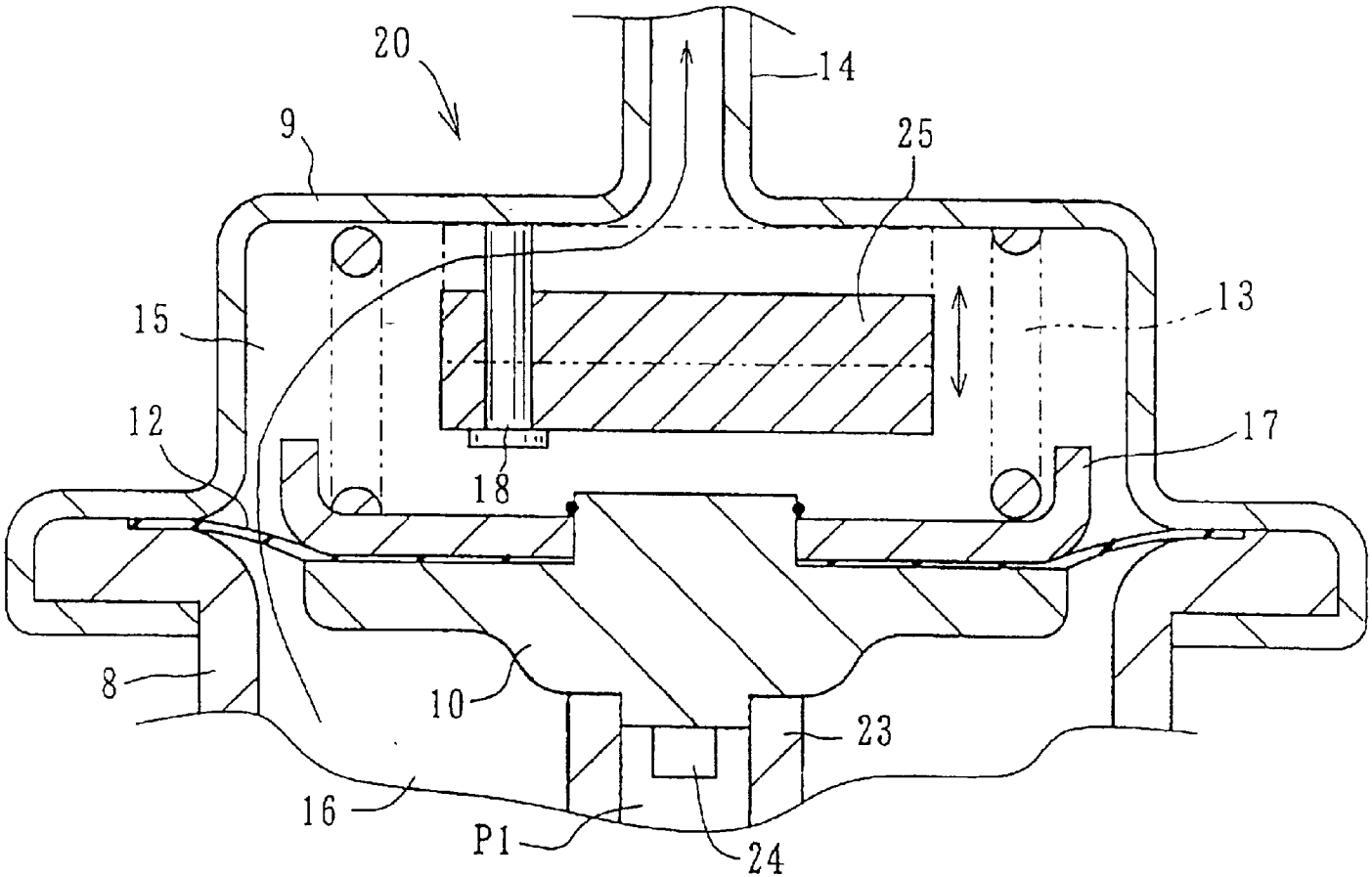
FIG. 5 is a drawing relating to the second embodiment corresponding to FIG. 3.
Figure 6:
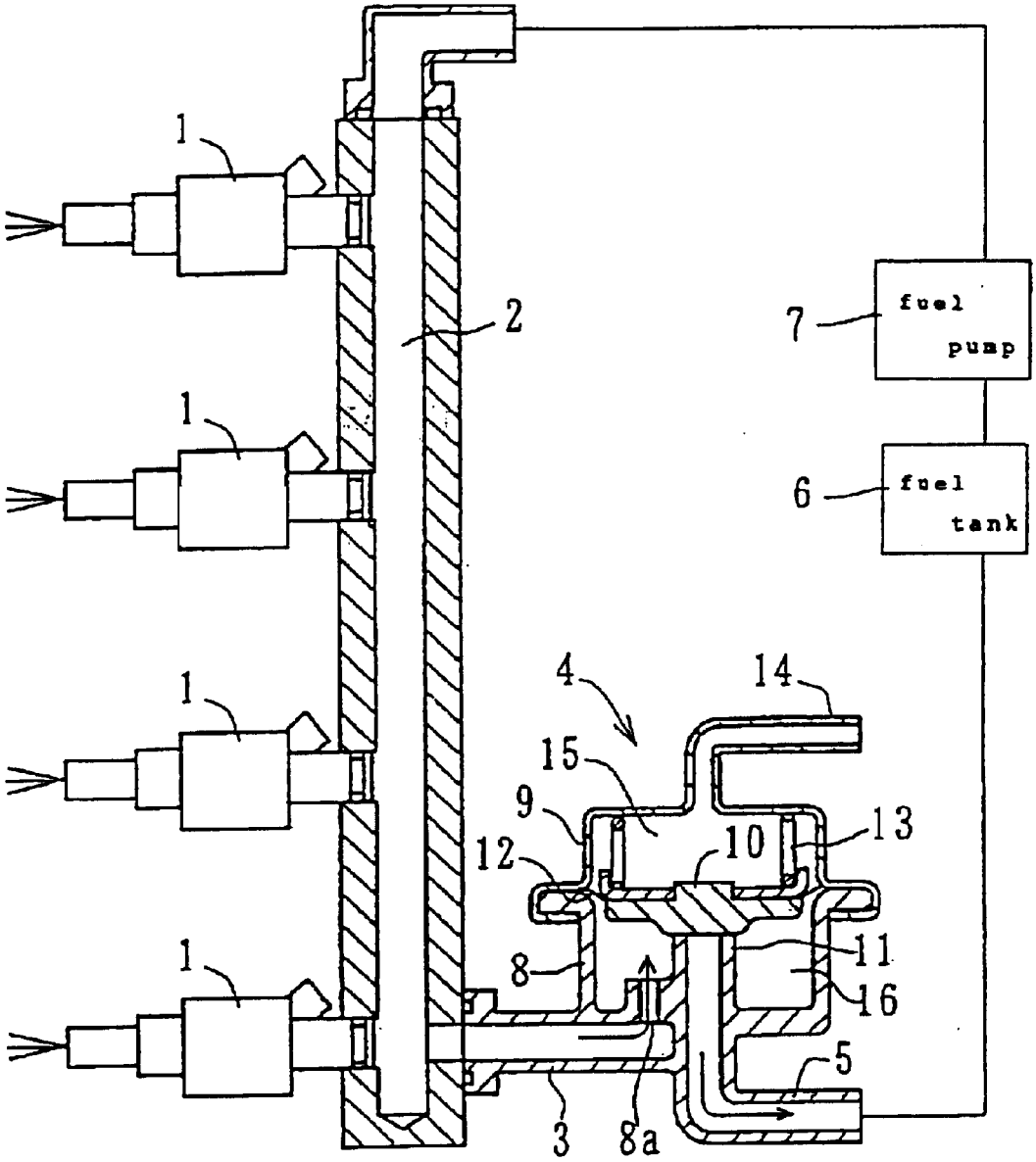
FIG. 6 is a drawing relating to the fuel injection circuit in the related art.

Referring now to FIG. 4 and FIG. 5, the second embodiment will be described. FIG. 4 is a drawing relating to the present embodiment, which corresponds to FIG. 2, and likewise FIG. 5 corresponds to FIG. 3. The common parts as the previous embodiments are represented by the common reference numerals and signs, and in principle, the common parts are simply shown by the common reference numerals and signs, and will not be described in detail again. This example also includes the first pressure regulating valve 20 and the second pressure regulating valve 21, two in total, in parallel as pressure regulating means 4. Three pressure regulating valves as described above will be provided arbitrarily.

The first pressure regulating valve 20 is adapted to open and close the entry of separate passage 23 shunted via the first orifice 22 for controlling the amount of return flow from the reflux passage 3 by means of the valve body 10, and the separate passage 23 serves as an entrance to the first pressure regulating valve. The first sensor 24 for detecting the fuel pressure applied on the first pressure regulating valve 20 is provided downstream of the first orifice 22 in the vicinity of the valve body 10 located therein. The fuel pressure detected by the first sensor 24 is represented by P1.

The second pressure regulating valve 21 is formed on a reflux passage extension 36 of the reflux passage 3 in the same construction as the first pressure regulating valve 20. The reflux passage extension 36 is a thinner passage than the reflux passage 3, and serves as an entrance to the second pressure regulating valve. The second orifice 27 for controlling the quantity of return flow with respect to the second pressure regulating valve 21 is provided at the connecting point to the reflux passage 3 as in the case of the first orifice 22. The first and the second orifices 21, 22 are adapted to generate the lowest limit setting pressure with the full quantity of flow in the reflux passage, respectively.

The end of the reflux passage extension 36 forms a seat 11, which is opened and closed by the valve body 10. The second sensor 28 is provided in the vicinity of the seat 11 to detect the fuel pressure in the reflux passage extension 36 applied on the second pressure regulating valve 21 positioned downstream of the second orifice 27. The detected fuel pressure is represented by P2. The first orifice 22 and the second orifice 27 are adapted to maintain the fuel pressures P1, P2 on the downstream side at almost the same pressure (P1≈P2) respectively when the first pressure regulating valve 20 and the second pressure regulating valve 21 are in the normal condition. Control based on the detected fuel pressures P1, P2 is the same as in the previous embodiment.

The liquid chambers 16 formed in the respective housings 8 of the first pressure regulating valve 20 and the second pressure regulating valve 21 are directly communicated with each other by the by-pass passage 29, so that the fuel flowing out of the first pressure regulating valve 20 flows into the liquid chamber 16 in the housing 8 directly without passing through the reflux passage extension 36 via the by-pass passage 29 when the valve body 10 of the first pressure regulating valve 20 is opened. The exit passage 5 serves as a passage for combined fuel from the first pressure regulating valve 20 and the second pressure regulating valve 21. FIG. 5 is an enlarged drawing showing the internal structure of the first pressure regulating valve 20 (the same for the second pressure regulating valve 21). Most parts are the same as the previous embodiments.

The operation of the present embodiment will now be described. In FIG. 1, when the first pressure regulating vale 20 and the second pressure regulating valve 21 are both in the normal conditions, the expression:

$$P<P0=P1=P2$$

is satisfied. In such a normal condition, the first pressure regulating valve 20 and the second pressure regulating valve 21 are closed, respectively, and thus the reflux passage 3 is not connected to the fuel tank 6, so that the fuel pressure in the fuel injection passage 2 is maintained at the predetermined value P.

When the fuel pressure in the fuel injection passage 2 increases and the expression $P \geqq P0=P1=P2$ is satisfied, the valve bodies 10, 10 of the first pressure regulating valve 20 and the second pressure regulating valve 21 are opened by the respective fuel pressures P1, P2. When the first pressure regulating valve 20 opens, the fuel is refluxed to the fuel tank 6 through the route of the reflux passage 3, the by-pass passage 29, the second pressure regulating valve 21 and the exit passage 5.

When the second pressure regulating valve 21 opens, the fuel is refluxed to the fuel tank 6 through the route of the reflux passage 3, the reflux passage extension 36 and the exit passage 5. In any cases, the fuel pressure of the fuel injection passage 2 is lowered to the normal values.

When the first pressure regulating valve 20 or the second pressure regulating valve 21 are in the abnormal condition, for example, when the defective condition such that the first pressure regulating valve 20 is kept opened occurs, the fuel in the reflux passage 3 passes through the by-pass passage 29, and flows into the housing 8 of the second pressure regulating valve 21, and then flows out from the exit passage 5. In this case, the fuel pressure in the reflux passage 3 is maintained at the predetermined setting pressure by the first orifice 22, and thus is equivalent to P2 but lower than P1.

When the fuel pressure in the reflux passage 3 is further increased temporarily in this state, the normal second pressure regulating valve 21 is opened to lower the fuel pressure. When the fuel pressure is lowered by the fuel consumption of the engine, the control by the normal second pressure regulating valve 21 becomes possible. Therefore, the fuel pressure of the fuel injection passage 2 is adequately maintained by the second pressure regulating valve 21 in the same manner as in the normal condition.

In contrast thereto, when the second pressure regulating valve 21 is kept opened, the fuel continuously flows from the reflux passage extension 36 through the housing 8 and the liquid chamber 16 into the fuel tank 6. Therefore, the fuel pressure in the reflux passage 3 is maintained at the predetermined lowest limit setting pressure by the second orifice 27, and thus is equivalent to P1 but lower than P2. In the same manner as the case described above, the fuel pressure in the fuel injection passage 2 can be maintained at the value close to the predetermined fuel pressure P to prevent a malfunction of the engine by opening and closing the first pressure regulating valve 20 based on the comparison between P and P1 even when fuel continuously flows out from the reflux passage extension 36.

On the other hand, when the first pressure regulating valve 20 is kept closed, the fuel in the reflux passage 3 enters into the second pressure regulating valve 21 through the reflux passage extension 36. Therefore, the fuel pressure in the reflux passage 3 may be controlled by opening and closing the valve body 10 of the second pressure regulating valve 21. In contrast thereto, when the second pressure regulating valve 21 is kept closed, the fuel in the reflux passage 3 enters into the first pressure regulating valve 20. Therefore, the fuel pressure in the reflux passage 3 may be controlled by opening and closing the valve body 10 of the first pressure regulating valve 20. Therefore, in any case, the fuel pressure in the reflux passage 3 and hence in the fuel injection passage 2 may be controlled to fall within the predetermined range.

Therefore, according to this embodiment, the redundant mechanism is constructed by providing the first and the second pressure regulating valves 20, 21, whereby the fuel pressure may be maintained at a pressure near the fuel pressure P in the fuel injection passage 2 even when either one of the pressure regulating valves are in the defective condition.

In the abnormal condition, the method of determination and notification of the abnormal side based on the differential pressure between P1 and P2 of the first and the second pressure regulating valves 20, 21 is the same as in the previous embodiments, whereby the occurrence of a defective condition and the place where the defective conditions occurred can be recognized immediately. Thus, quick and adequate countermeasures may be taken in the defective operating conditions.

The present invention is not limited to the embodiments described above, and various modifications or application may be made within the same principle of the invention. For example, there may be provided three or more pressure regulating valves for constituting the pressure regulating means. The escape prevention valve is not limited to a float. The escape prevention valve may be opened and closed by a solenoid or the like. The fuel is not limited to liquid. The fuel may be gas as well. In this case, the escape prevention valve must simply be a check valve that closes the opening of the negative pipe 14 by a spring as the pressure in the air chamber 15 increases instead of the float 25.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A fuel injection apparatus for an engine comprising:

a fuel pump for pumping fuel from a fuel tank to a fuel injection passage;

an injector for injecting fuel from said fuel injection passage; and pressure regulating means disposed between the fuel injection passage and the fuel tank for regulating the fuel pressure in said fuel injection passage at a constant value;

wherein said pressure regulating means includes a first pressure regulating valve and a second pressure regulating valve, said first pressure regulating valve and the second pressure regulating valve are connected at the entrances thereof to said fuel injection passage via a first and second orifice, respectively, said first pressure regulating valve and the second pressure regulating valve are connected at the exits thereof to said fuel tank, respectively, a first pressure sensor for detecting the fuel pressure applied on the downstream of said first orifice, and a second pressure sensor for detecting the fuel pressure applied on the downstream of said second orifice, and failure diagnostic means for notifying of the occurrence of the defective conditions by a predetermined display when the fuel pressures detected by said first pressure sensor and the second pressure sensor are different.

2. The fuel injection apparatus for an engine according to claim 1, wherein said first pressure regulating valve includes a seat with a valve body being operatively positioned relative to said seat, a biasing member is disposed between a housing for said first pressure regulating valve and said valve seat for biasing said valve body into a normally closed position.

3. The fuel injection apparatus for an engine according to claim 2, and further including a negative pressure source operatively connected to said housing for said first pressure regulating valve and a float being positioned between an opening for said negative pressure source and said first pressure regulating valve for preventing an escape of fuel from said housing when said first pressure regulating valve is moved to an opened position.

4. The fuel injection apparatus for an engine according to claim 1, wherein said pressure regulating means is disposed within a reflux passage disposed between the fuel injection passage and the fuel tank.

5. The fuel injection apparatus for an engine according to claim 4, wherein said first orifice is of a predetermined size for providing a lowest limit setting pressure when the full quantity of flow is provided in the reflux passage.

6. The fuel injection apparatus for an engine according to claim 2, and further including a exit passage extension disposed adjacent to the valve seat for permitting a flow of fuel to said fuel tank when said valve body is moved to an opened position.

7. The fuel injection apparatus for an engine according to claim 1, wherein said second pressure regulating valve includes a seat with a valve body being operatively positioned relative to said seat, a biasing member is disposed between a housing for said second pressure regulating valve and said valve seat for biasing said valve body into a normally closed position.

8. The fuel injection apparatus for an engine according to claim 7, and further including a negative pressure source operatively connected to said housing for said second pressure regulating valve and a float being positioned between an opening for said negative pressure source and said second pressure regulating valve for preventing an escape of fuel from said housing when said second pressure regulating valve is moved to an opened position.

9. The fuel injection apparatus for an engine according to claim 2, wherein said second pressure regulating valve is disposed within a reflux passage disposed between the fuel injection passage and the fuel tank.

10. The fuel injection apparatus for an engine according to claim 9, wherein said second orifice is of a predetermined size for providing a lowest limit setting pressure when the full quantity of flow is provided in the reflux passage.

11. The fuel injection apparatus for an engine according to claim 7, and further including a exit passage extension disposed adjacent to the valve seat for the second pressure regulating valve for permitting a flow of fuel to said fuel tank when said valve body is moved to an opened position.

* * * * *